US012098606B2

(12) United States Patent
Casanova et al.

(10) Patent No.: US 12,098,606 B2
(45) Date of Patent: Sep. 24, 2024

(54) TREATMENT SYSTEM, METHOD, AND BOREHOLE SYSTEM

(71) Applicants: Gabriel Casanova, Spring, TX (US); Todd C. Jackson, Houston, TX (US); Aaron Young, Tomball, TX (US)

(72) Inventors: Gabriel Casanova, Spring, TX (US); Todd C. Jackson, Houston, TX (US); Aaron Young, Tomball, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 37 days.

(21) Appl. No.: 17/890,399

(22) Filed: Aug. 18, 2022

(65) Prior Publication Data

US 2024/0060375 A1 Feb. 22, 2024

(51) Int. Cl.

| | |
|---|---|
| ***E21B 23/00*** | (2006.01) |
| ***E21B 23/06*** | (2006.01) |
| ***E21B 33/124*** | (2006.01) |
| ***E21B 33/128*** | (2006.01) |
| ***E21B 33/1295*** | (2006.01) |

(Continued)

(52) U.S. Cl.

CPC ..... *E21B 23/06* (2013.01); *E21B 23/006* (2013.01); *E21B 33/124* (2013.01); *E21B 33/128* (2013.01); *E21B 33/12955* (2013.01); *E21B 34/101* (2013.01); *E21B 43/14* (2013.01); *E21B 43/26* (2013.01); *E21B 43/267* (2013.01)

(58) Field of Classification Search

CPC .. E21B 23/006; E21B 33/12955; E21B 43/26; E21B 43/2605; E21B 43/2607; E21B 43/27; E21B 33/128

See application file for complete search history.

(56) References Cited

U.S. PATENT DOCUMENTS 5,197,547 A 3/1993 Morgan
9,745,826 B2 * 8/2017 Getzlaf ..... E21B 34/14

(Continued)

FOREIGN PATENT DOCUMENTS

EP 1218619 B1 7/2004

OTHER PUBLICATIONS

International Search Report and Written Opinion; PCT/US2022/041562; Korean Intellectual Property Office; Mailed Dec. 20, 2022; 11 pages.

*Primary Examiner* — Catherine Loikith

(74) *Attorney, Agent, or Firm* — CANTOR COLBURN LLP

(57) ABSTRACT

A treatment system including a settable and unsettable seal sub, an operation sub connected to the seal sub, the operation sub including a flow restrictor, and a selectively openable port biased to a closed position. A borehole system including a slickline, and a resettable seal connected to the slickline and runnable in the borehole on the slickline. A method for treating a formation adjacent a borehole including running the treatment system on a slickline to a target depth, flowing past the flow restrictor thereby causing the flow restrictor and a mandrel upon which the restrictor is mounted to move toward the seal sub, partially setting the seal sub and increasing pressure on the seal sub thereby fully setting the seal sub. A borehole system, including a borehole in a subsurface formation, a treatment system disposed within the borehole.

17 Claims, 5 Drawing Sheets

(51) Int. Cl.

| | |
|---|---|
| ***E21B 34/10*** | (2006.01) |
| ***E21B 43/14*** | (2006.01) |
| ***E21B 43/26*** | (2006.01) |
| ***E21B 43/267*** | (2006.01) |

(56) References Cited

U.S. PATENT DOCUMENTS

| | | | |
|---|---|---|---|
| 2014/0305648 | A1 | 10/2014 | Getzlaf et al. |
| 2020/0032613 | A1 | 1/2020 | Angman et al. |
| 2021/0148179 | A1 | 5/2021 | Petrella et al. |
| 2021/0372254 | A1 | 12/2021 | Thomas et al. |

* cited by examiner

TREATMENT SYSTEM, METHOD, AND BOREHOLE SYSTEM

CROSS REFERENCE TO RELATED APPLICATIONS

This application is a non-provisional application and claims the benefit of an earlier filing date from U.S. Provisional Application Ser. No. 62/237,255 filed Aug. 26, 2021, the entire disclosure of which is incorporated herein by reference.

BACKGROUND

Treatment including fracturing is an important part of operations in a borehole environment whether for resource recovery or fluid sequestration. Treating apparatus tend to be complicated with a number of tools required and need to be run on pipe or coiled tubing. Fracturing is typically undertaken from the bottom up in a borehole using different sized plugs starting with the smallest at the most downhole target of the interval to be fractured and increasing plug size by a small amount for each subsequent fracture zone moving in the uphole direction. The operations are costly and time consuming such that the art is receptive to alternative methods and systems for accomplishing fracture or refracture in the borehole.

SUMMARY

An embodiment of a treatment system including a settable and unsettable seal sub, an operation sub connected to the seal sub, the operation sub including a flow restrictor, and a selectively openable port biased to a closed position.

An embodiment of a borehole system including a slickline, and a resettable seal connected to the slickline and runnable in the borehole on the slickline.

A method for treating a formation adjacent a borehole including running the treatment system on a slickline to a target depth, flowing past the flow restrictor thereby causing the flow restrictor and a mandrel upon which the restrictor is mounted to move toward the seal sub, partially setting the seal sub and increasing pressure on the seal sub thereby fully setting the seal sub.

A borehole system, including a borehole in a subsurface formation, a treatment system disposed within the borehole.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
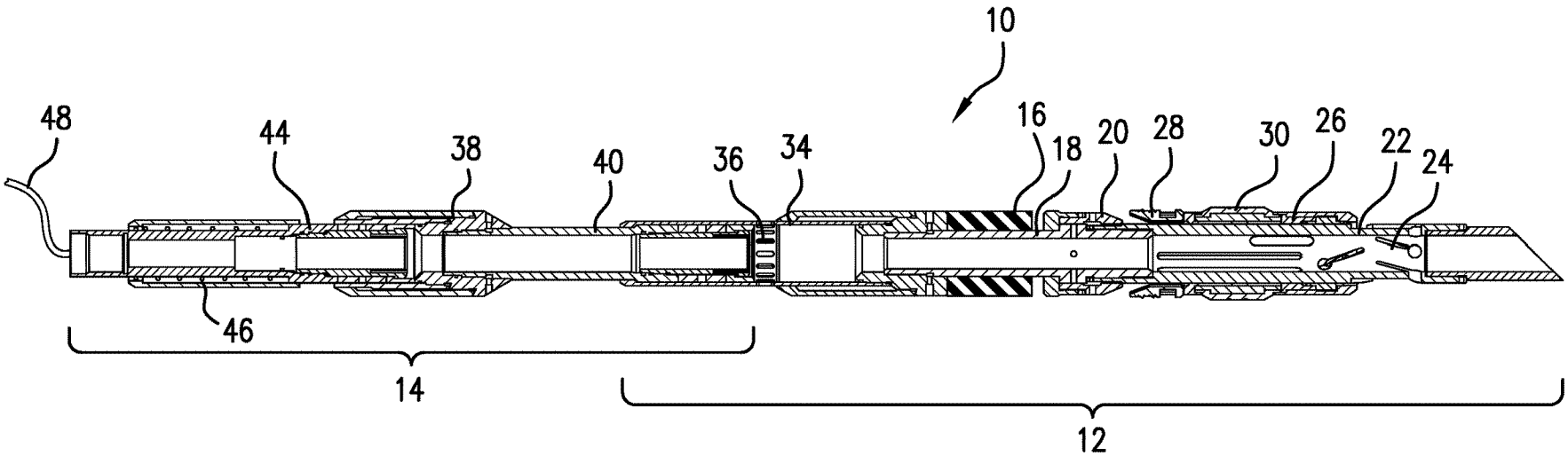
FIGS. 1-4 are cross sectional views of a treatment system in sequential positions of operation.
Figure 3:
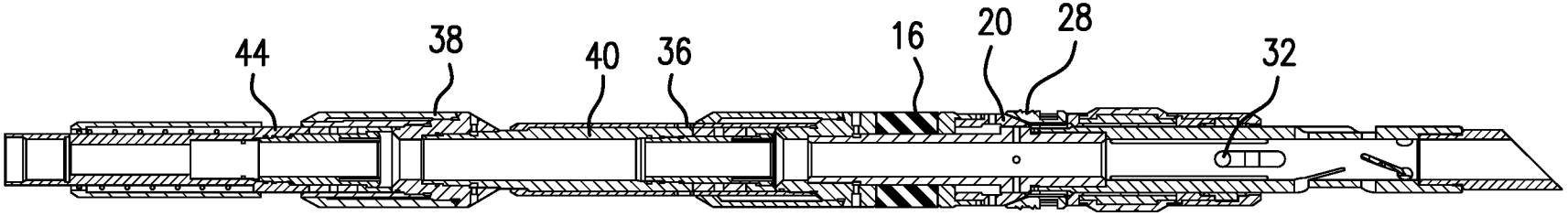
Figure 4:
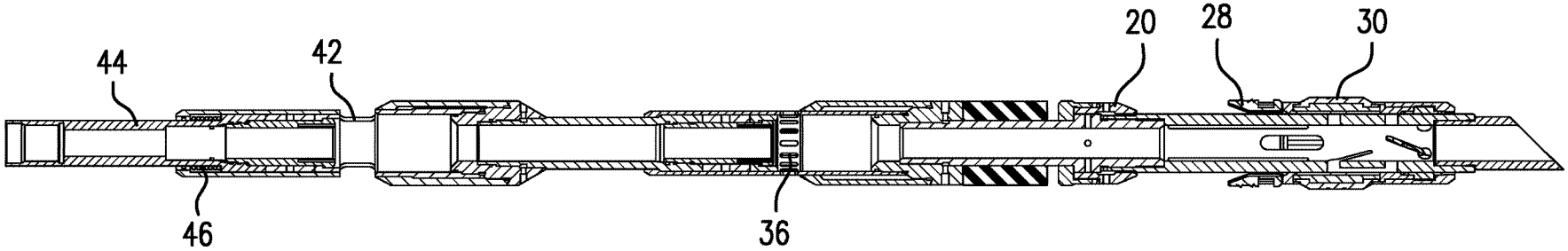

Referring to FIG. 1, a treatment system 10, which treatment may be fracturing, acidizing, etc.) is illustrated in a run in position. The system 10 comprises a settable and resettable seal sub 12 and an operation sub 14 connected to the seal sub 12. The seal sub 12 includes an element 16 disposed on a mandrel 18. A cone 20 is also disposed on the mandrel 18. A mandrel extension 22 is attached to the mandrel 18 and includes a J-slot groove 24 therein. An anchor sleeve 26 is slidably disposed on the mandrel 18 and mandrel extension 22. The sleeve 26 includes a slip 28, a drag block 30 and a J-slot follower 32 (see FIG. 3). In some positions of the follower 32, the sleeve may be displaceable relative to the cone 20 sufficiently to actuate the slip 28 and anchor the system 10 in a borehole or casing (radially outwardly located relative to the system 10). In other positions of the follower 32, the sleeve 26 is prevented from moving enough to engage the cone 20. Stated alternately, the J-slot groove 24 causes rotation of the sleeve 26 from a running position where the sleeve is prevented from engaging the cone 20 to a setting position where the sleeve is permitted to engage the cone 20. In the latter position, the groove 24 has a longer segment running axially of the extension 22 to permit the desired motion of the sleeve 26 into engagement with the cone 20. The seal sub 12 further includes an equalization port housing 34 having an equalization port 36. When the port 36 is open, flow can pass from outside of system 10 from uphole thereof through port 36 and then inside of the seal sub 12 to downhole of the system 10.

Figure 2:
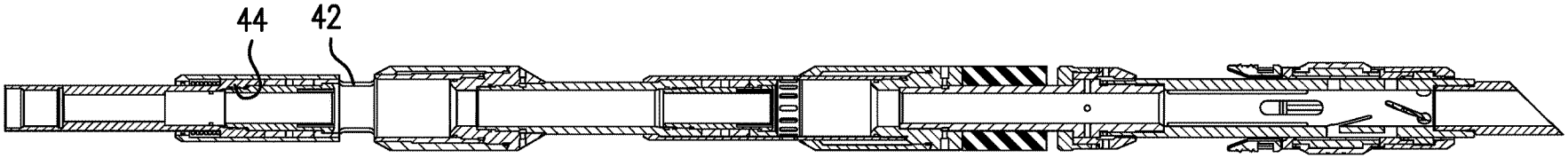

The operation sub 14 includes a flow restrictor 38 disposed upon a port control mandrel 40. Flow restrictor 38 may be an upset member or may be one or more cups, or may be other structures that reduce flow area between the restrictor 38 and the borehole in which the system 10 is disposed. The port control mandrel 40 is slidable in the port housing 34 of the seal sub 12 and depending upon its position relative thereto will either cover or uncover the port 36. Sub 14 further includes an unloading port 42 (see FIG. 2) uphole of the restrictor 38. The port 42 is covered or uncovered based upon a position of an unloader mandrel 44, slidable relative to the port control mandrel 40. In an embodiment, the mandrel 44 is biased to a port 42 closed position by a spring 46 and may be moved to a port 42 open position through the application of a tensile load on the mandrel 44 from a slickline 48 upon which the system 10 is run.

Referring to FIGS. 1-4 sequentially, the system 10 is run into a borehole in the position illustrated in FIG. 1 on slickline 48. When a target depth is reached in the borehole, the slickline is pulled up by a short distance of about a foot. Because the anchor sleeve 26 includes the drag block 30 (two visible in the figure but any number is contemplated), the sleeve 26 will stay relatively stationary. The rest of the system 10 moves the short distance uphole and the J-slot follower 32 will index on the J-slot groove 24 into a position where the sleeve 26 is free to move far enough relative to the rest of the system 10 that the slips 28 will engage the cone 20 and begin to expand radially outwardly into contact with the borehole or casing within which the system 10 is disposed. In this position, tension in the slickline 48 is reduced (slack weight) though it is noted that slickline does not permit weight to be transferred to the system 10 since slickline is a tensile rather than a compressive member. Pumping is also initiated at this time so that the system 10 is pumped in the downhole direction while the sleeve 26 is anchored in place. This will begin to load the element 16. Simultaneously, the flow from the pumps is caused to flow over the restrictor 38 thereby causing the operation sub 14 to push the system 10 except for the sleeve 26 in the downhole direction. The movement causes the slips 28 to set more securely and causes the element to create a seal. The equalization port 36 is closed by this movement due to port control mandrel 40 sliding relative to the port housing 34, again due to the fluid flow over the restrictor 38. In this position (illustrated in FIG. 3) pressure from the pumps in a surface system is increased to fully set the element. Once the element 16 is fully set, pressure may be raised to treatment pressure including fracture pressure. Once the treatment is concluded, diverters are flowed to the treatment site to temporarily seal off whatever treatment openings are being used through which to treat the formation. At this point, pressure may be bled off and the equalization port opened by pulling on the slickline, thereby moving the port control mandrel 40 uphole beyond the equalizing port 36. This allows pressure equalization uphole and downhole of the element 16. Further uphole pull by the slickline causes the unloader mandrel 44 to compress spring 46 to uncover unloader port 42. Movement of the system 10 in the uphole direction based upon the slickline 48 pull will unsupport the slip 28 on the cone 20 and then will result in the follower 32 again following the J-slot groove 24 to a position for running. In that position, the sleeve 26 is prevented from engaging the cone 20. The system 10 may then be pumped to the next target location, which may be downhole of the previous target location and the process repeated indefinitely until all target locations are treated.

Figure 5:
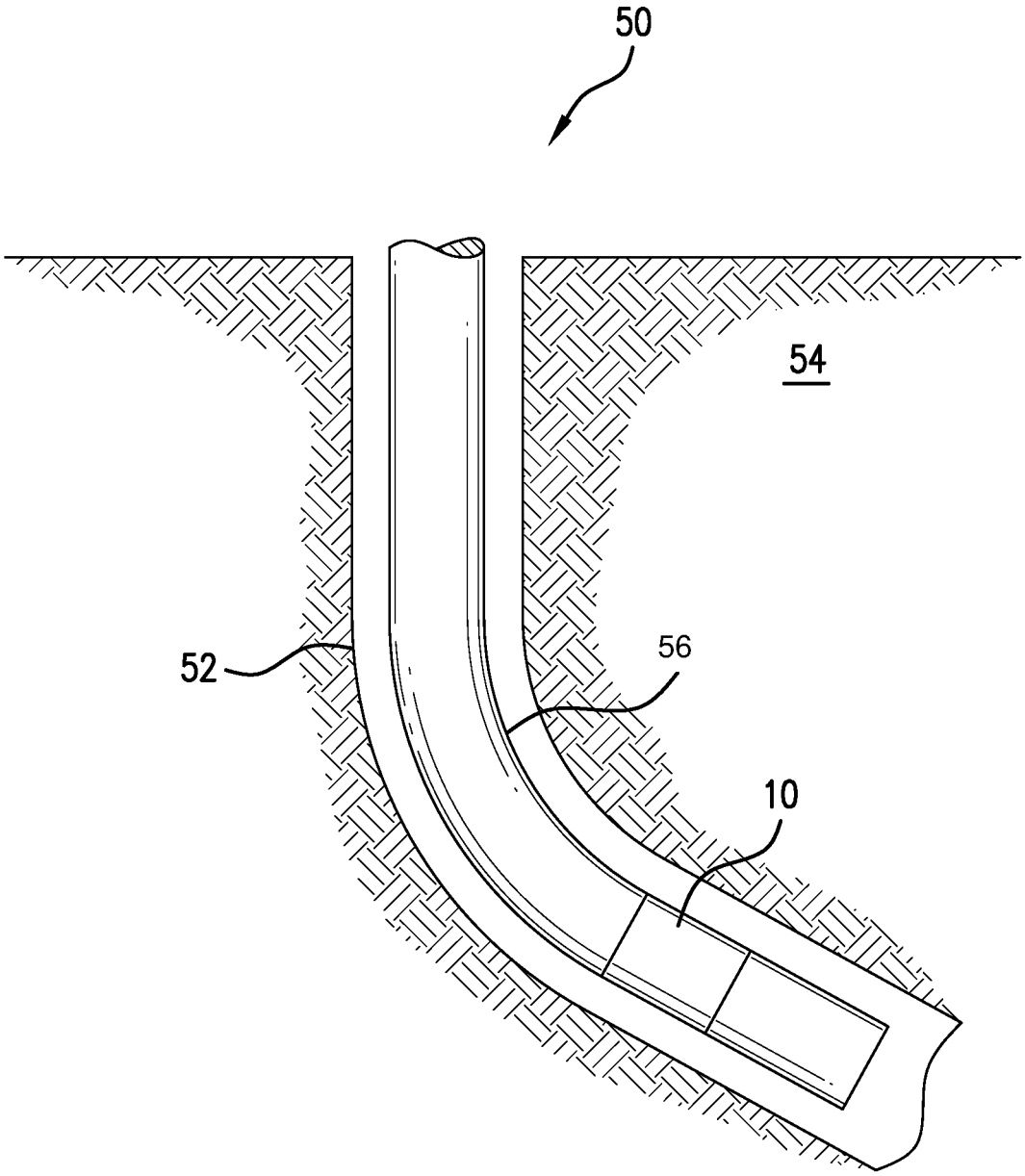
FIG. 5 is a schematic view of a borehole system within which is disposed the treatment system disclosed herein.

Referring to FIG. 5, a borehole system 50 is illustrated. The system 50 comprises a borehole 52 in a subsurface formation 54. A string 56 is disposed within the borehole 52. A treatment system 10 is disposed within or as a part of the string 56.

Set forth below are some embodiments of the foregoing disclosure:

Embodiment 1: A treatment system including a settable and unsettable seal sub, an operation sub connected to the seal sub, the operation sub including a flow restrictor, and a selectively openable port biased to a closed position.

Embodiment 2: The system as in any prior embodiment, wherein the flow restrictor is an upset member.

Embodiment 3: The system as in any prior embodiment, wherein the flow restrictor is responsive to fluid drag and differential pressure to move a mandrel toward the seal sub to actuate the seal sub.

Embodiment 4: The system as in any prior embodiment, wherein the flow restrictor includes a cup.

Embodiment 5: The system as in any prior embodiment, wherein the cup is a plurality of cups.

Embodiment 6: The system as in any prior embodiment, wherein the operation sub includes a biaser configured to cause the bias to the closed position.

Embodiment 7: The system as in any prior embodiment, wherein the biaser is a compression spring.

Embodiment 8: The system as in any prior embodiment, wherein the port is openable by tension applied to the operation sub.

Embodiment 9: The system as in any prior embodiment, wherein the seal sub includes a J-slot mechanism.

Embodiment 10: The system as in any prior embodiment, wherein the seal sub includes an anchor.

Embodiment 11: The system as in any prior embodiment, wherein the seal sub includes a drag block.

Embodiment 12: A borehole system including a slickline, and a resettable seal connected to the slickline and runnable in the borehole on the slickline.

Embodiment 13: The system as in any prior embodiment, wherein the seal is actuable for setting and unsetting responsive to slack off, overpull from the slickline.

Embodiment 14: The system as in any prior embodiment, wherein the seal is further responsive to fluid flow for completion of the setting.

Embodiment 15: A method for treating a formation adjacent a borehole including running the treatment system as in any prior embodiment on a slickline to a target depth, flowing past the flow restrictor thereby causing the flow restrictor and a mandrel upon which the restrictor is mounted to move toward the seal sub, partially setting the seal sub and increasing pressure on the seal sub thereby fully setting the seal sub.

Embodiment 16: The method as in any prior embodiment, further comprising pressuring up to fracture the formation.

Embodiment 17: The method as in any prior embodiment, further comprising pulling on the system to cycle a J-slot to a position where setting is enabled.

Embodiment 18: The method as in any prior embodiment, further including pulling on the system, equalizing pressure across the seal, opening a port uphole of the restrictor, and tripping the system to another target location.

Embodiment 19: The method as in any prior embodiment wherein the another target location is downhole of the previous target location.

Embodiment 20: A borehole system, including a borehole in a subsurface formation, a treatment system as in any prior embodiment disposed within the borehole.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A borehole system, comprising:

a slickline; and a resettable seal connected to the slickline and runnable in the borehole on the slickline, the seal is actuable for setting and unsetting responsive to slack off or overpull from the slickline, wherein the seal is further responsive to fluid flow for completion of the setting.

2. A treatment system comprising:

a settable and unsettable seal sub;

an operation sub connected to the seal sub, the operation sub including:

a flow restrictor; and a selectively openable port biased to a closed position, wherein the flow restrictor is responsive to fluid drag and differential pressure to move a mandrel toward the seal sub to actuate the seal sub.

3. The system as claimed in claim 2, wherein the flow restrictor is an upset member.

4. The system as claimed in claim 2, wherein the flow restrictor includes a cup.

5. The system as claimed in claim 4, wherein the cup is a plurality of cups.

6. The system as claimed in claim 2, wherein the operation sub includes a biaser configured to cause the bias to the closed position.

7. The system as claimed in claim 6, wherein the biaser is a compression spring.

8. The system as claimed in claim 2, wherein the port is openable by tension applied to the operation sub.

9. The system as claimed in claim 2, wherein the seal sub includes a J-slot mechanism.

10. The system as claimed in claim 2, wherein the seal sub includes an anchor.

11. The system as claimed in claim 2, wherein the seal sub includes a drag block.

12. A method for treating a formation adjacent a borehole, comprising:

running the treatment system as claimed in claim 2 on a slickline to a target depth;

flowing past the flow restrictor thereby causing the flow restrictor and a mandrel upon which the restrictor is mounted to move toward the seal sub;

partially setting the seal sub; and increasing pressure on the seal sub thereby fully setting the seal sub.

13. The method as claimed in claim 12, further comprising pressuring up to fracture the formation.

14. The method as claimed in claim 12, further comprising pulling on the system to cycle a J-slot to a position where setting is enabled.

15. The method as claimed in claim 12, further comprising:

pulling on the system;

equalizing pressure across the seal;

opening a port uphole of the restrictor; and tripping the system to another target location.

16. The method as claimed in claim 15 wherein the another target location is downhole of the previous target location.

17. A borehole system, comprising:

a borehole in a subsurface formation; and a treatment system as claimed in claim 2 disposed within the borehole.

* * * * *